United States Patent [19]

Higgs et al.

[11] Patent Number: 4,751,463

[45] Date of Patent: Jun. 14, 1988

[54] INTEGRATED VOLTAGE REGULATOR CIRCUIT WITH TRANSIENT VOLTAGE PROTECTION

[75] Inventors: Jacob K. Higgs, Salisbury; Hideki Kawaji, Franklin; Ravi Vig, Concord, all of N.H.

[73] Assignee: Sprague Electric Company, North Adams, Mass.

[21] Appl. No.: 56,167

[22] Filed: Jun. 1, 1987

[51] Int. Cl.[4] ..... G05F 3/26

[52] U.S. Cl. ..... 323/314; 323/315; 323/281; 361/111

[58] Field of Search ..... 323/313, 314, 315, 280, 323/281, 303, 231; 361/18, 56, 91, 111

[56] References Cited

U.S. PATENT DOCUMENTS

| | | | |
|---|---|---|---|
| 3,426,263 | 2/1969 | Hennigan et al. | 323/231 X |
| 3,996,498 | 12/1976 | Schade, Jr. | 323/315 X |
| 4,612,497 | 9/1986 | Ulmer | 323/315 |

OTHER PUBLICATIONS

Widlar, "New Developments in IC Voltage Regulators", IEEE Journal of Solid-State Circuits, vol. sc-6, No. 1, Feb. 1971.

"Hazardous Areas", Electrical Review, vol. 205, No. 8, 8/31/79, p. 35.

*Primary Examiner*—Patrick R. Salce
*Assistant Examiner*—Kristine Peckman

[57] ABSTRACT

An integrated circuit voltage regulator is of the kind having a pass transistor connected collector-to-emitter between the input $V_{CC}$ conductor and the regulated-voltage output conductor, a current source circuit supplying a base bias current to the pass transistor and a voltage reference and feedback regulator circuit connected between the output voltage conductor and the base of the pass transistor. A protective circuit against high voltage transients adding to $V_{CC}$ voltage comprises a transistor connected collector-to-emitter between the pass-transistor base and ground has a resistor paralleling the base-emitter junction, which resistor is resistively coupled to the input $V_{CC}$ line to shunt away the pass-transistor bias current whenever the $V_{CC}$ voltage level exceeds a value just under the latch-back breakdown voltage of the pass transistor. A zener diode directly connected across the DC input voltage conduction renders the regulator even more tolerant of high voltage transients.

6 Claims, 2 Drawing Sheets

INTEGRATED VOLTAGE REGULATOR CIRCUIT WITH TRANSIENT VOLTAGE PROTECTION

BACKGROUND OF THE INVENTION

This invention relates to DC voltage regulators including a voltage-reference circuit and more particularly to such a regulator that further includes a means for preventing damage to the regulator from high transient voltages that may superimpose on the DC supply voltage.

A prior art voltage regulator circuit is shown in FIG. 1. It is formed in an integrated silicon circuit chip 10 having a ground terminal 12 and a DC supply voltage terminal 14 to which a DC voltage, $+V_{cc}$, may be applied. A regulated voltage, $V_{REG}$, is provided at output conductor 16 to which a load (not shown) may be connected.

This circuit includes a constant current source circuit 20 made up of transistors 21, 22 and 23 plus resistors 24 and 25. Also included is a current mirror circuit 27 consisting of transistors 28 and 29. The constant current 19 provided by the constant source current 20 is mirrored through current mirror 27 to provide a bias current 31 that serves as base bias for transistor 30. The series regulating pass transistor 30 drops the voltage from $V_{cc}$ to $V_{reg}$.

The band-gap regulator 32 senses the output voltage at conductor 16 and compares it to an internally generated constant voltage reference and diverts or sinks enough of current 30 to maintain the voltage at the desired level $V_{reg}$ over wide ranges of load current and source voltage $V_{cc}$. A first such circuit is described in the article "New Developments in IC Voltage Regulators", IEEE Journal of Solid State Circuits, Vol. SC-4, pp. 2–7, February 1971, by R. J. Widlar.

There have been combined with these kinds of voltage regulator circuits a variety of protective circuits. For example, a zener clamp may be connected across the pass transistor to prevent reverse breakdown of that transistor. In that case, it will be necessary to place such a clamp across the load as well. Also, current limiting circuits have been added to limit the pass transistor current to a safe value.

It is an object of this invention to provide a simple voltage regulator circuit having a protective means for preventing damage to the regulator circuit resulting from large voltage transients superimposed on the supply voltage.

SUMMARY OF THE INVENTION

An integrated circuit voltage regulator comprises a bipolar pass transistor connected collector-to-emitter between a conductor to which a DC voltage source is to be connected and a regulated-voltage output conductor to which a load is to be connected. A current source bias means is connected between the voltage source conductor and the pass-transistor base to bias on the pass transistor. A voltage regulator circuit means is connected between the regulated-voltage output conductor and the base of the pass transistor for regulating the DC voltage at the output conductor. A transient voltage protection circuit means is connected to the voltage-source conductor, to the pass-transistor base and to the ground conductor for shunting the base bias current away from said pass transistor when the voltage at said voltage source conductor exceeds a predetermined value. That value is one that is less than the latch-back breakdown voltage of the pass transistor.

The above-described protective feature in a voltage regulator of this invention is particularly useful when high noise spikes may appear superimposed on the DC voltage source that powers the integrated circuit. The lower amplitude ones of such noise spikes tend to be wider and to contain greater energy than the higher voltage spikes. A zener diode connected directly across the supply conductors ($V_{cc}$ to ground) without a protective series resistor is subject to destruction from broad though low voltage transients. A zener diode that breaks down at a substantially higher voltage than the above-noted predetermined value, but below the latch-back breakdown value of the pass transistors may be connected directly across the supply conductors, i.e. without a series resistor, to further protect against latch-back at those higher voltages because the zener diode is then exposed to only the high and narrow spikes that will not destroy it, as is further elaborated below.

DESCRIPTION OF THE PREFERRED EMBODIMENTS

Figure 2:
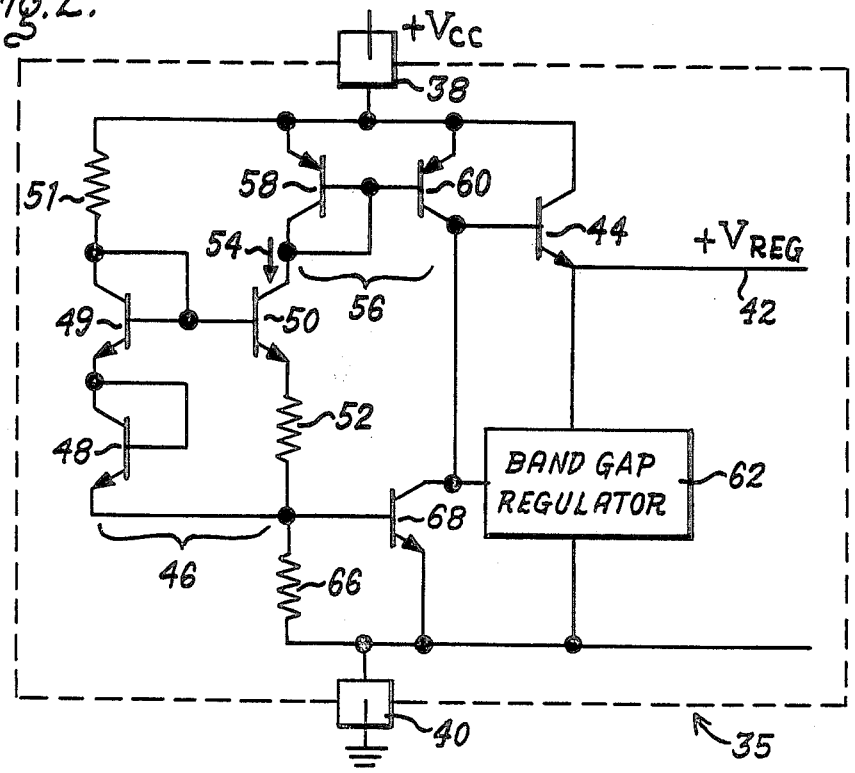
FIG. 2 shows an integrated voltage regulator circuit of this invention

The integrated circuit 35 shown in FIG. 2 has a DC input voltage terminal pad 38 and a ground terminal pad 40. This circuit provides an output voltage $V_{REG}$ at the output conductor 42. Other circuits (not shown) that are connected between conductor 42 and the ground terminal pad 40 are thus provided a regulated supply voltage $V_{REG}$. Those other circuits represent the load of the voltage regulator.

The voltage regulator has a series pass transistor 44 connected between the output conductor 42 and the DC input terminal pad 38. A constant current source 46 is made up of transistors 48, 49 and 50, and resistors 51 and 52. It provides a current 54 that is essentially constant for a wide range of values of the DC input voltage, $V_{cc}$. A current mirror circuit 56 made up of transistors 58 and 60 has an input connected to the output of the constant current source 46 and an output connected to the base of pass transistor 44. Some of this constant bias current supplied to the base of pass transistor 44 is shunted away by the band-gap voltage regulator circuit 62. By this means the output voltage at conductor 42 is regulated.

In this embodiment, the constant current source is not connected directly to the DC supply but rather is connected through a "sense" resistor 66 between terminal pads 38 and 40. The protective transistor 68 has the base emitter junction connected in parallel with the sense resistor 66, and the collector is connected to the base of the pass transistor 44. When the DC supply voltage, $V_{CC}$, exceeds a value for which the voltage drop across the sense resistor 66 is larger than one $V_{BE}$, about 0.6 volts, then transistor 66 turns on and diverts substantially all of the base bias current away from the base of the pass transistor 44. Under those conditions, the output current drops to near zero and, therefore, the output voltage at conductor 42 drops to near zero. The band gap-regulator 62 essentially becomes inoperative and ineffective. However, almost the entire DC supply voltage is then dropped across the pass transistor collector-to-emitter.

But at voltage levels across transistor 44 that are less than the avalanche breakdown voltage of the transistor, $BV_{CER}$, the pass transistor 44 is in no danger of overheating because there is little current flowing through it as long as protective transistor 68 is on. Further consideration is given below to the various modes of operation of circuits of this invention, with reference to the circuit of FIG. 3.

Figure 3:
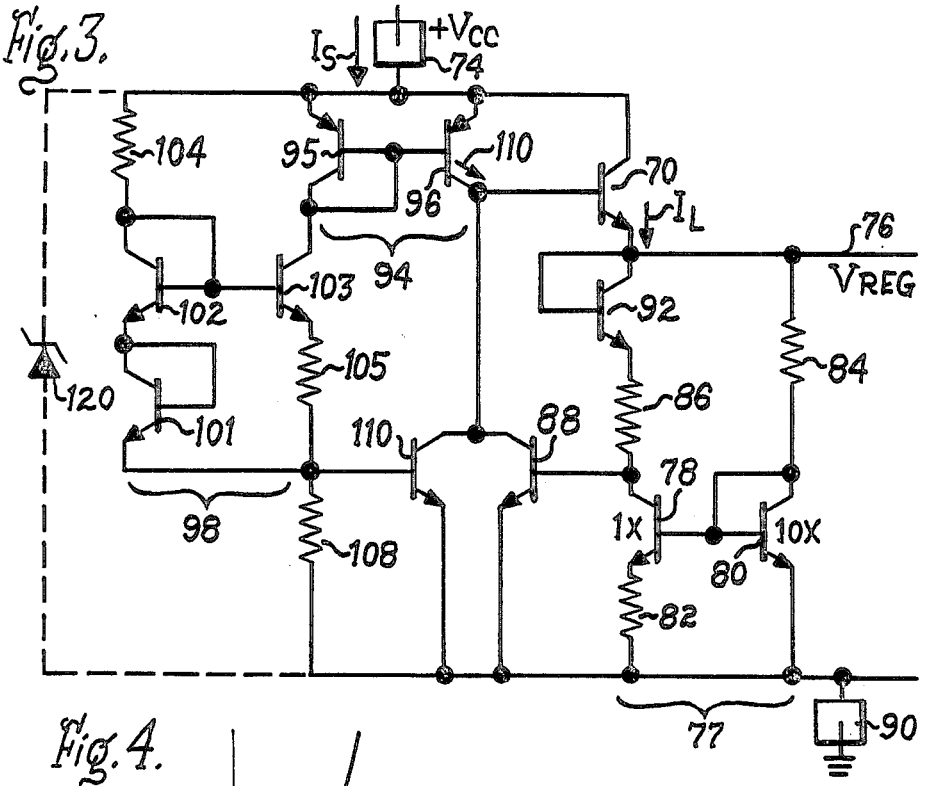
FIG. 3 shows another voltage regulator circuit of this invention.

In the second preferred embodiment shown in FIG. 3, the series-regulator pass transistor 70 conducts current $I_L$ from the DC input voltage terminal 74 to the load (not shown) via output conductor 76 and to the band-gap voltage-reference circuit 77. Circuit 77 includes two current-mirror-connected transistors 78 and 80 in which a stable DC reference voltage is dropped across emitter resistor 82 that is the difference between base-emitter voltages of transistors 80 and 78. The voltage across resistor 82 determines the current in transistor 78 and resistor 86.

A feedback transistor 88 is connected collector-to-emitter between the base of pass transistor 70 and the ground terminal 90. Since the voltage across the resistor 82 is relatively constant as are the $V_{BE}$ drops across one or more diodes such as diode 92, then so is the voltage across resistor 86 relatively constant. Thus the sum of the voltages dropped across diode 92, resistor 86 and the $V_{BE}$ drop across feedback transistor 88 must equal to the value of $V_{REG}$. When due to a change in the DC input voltage or the load that tends to develop too much or too little base voltage at feedback transistor 88 then transistor sinks more or less current from the bias current in the base of pass transistor 70 to maintain and regulate the voltage $V_{REG}$ at design value.

As in the circuit of FIG. 2, the pass-transistor bias current is supplied from a current mirror circuit 94 made up of transistors 95 and 96 that is in turn driven by a constant current source circuit 98 made up of transistors 101, 102 and 103 and of resistors 104 and 105.

The reference-circuit branch of current-source circuit 98, consisting of transistors 101 and 102 and of resistor 104 and the output current branch of the constant-current-source circuit 98 consisting of transistors 95 and 103 and of resistor 105, are parallel branches that are connected in series with the sense resistor 108 between the input power terminals 74 and 90. When the DC input voltage changes, current in the reference branch tends to change proportionally while the current in the output current branch remains relatively constant.

It is these changes in the reference current branch in response to change in DC input voltage, $V_{CC}$, that effects change in the voltage across the sense resistor 108. A prototype of the circuit of FIG. 3 has the resistor values shown in the Table below.

TABLE

| Resistors | Values (ohms) |
|---|---|
| 82 | 200 |
| 84 | 12K |
| 86 | 7.5K |
| 104 | 50K |
| 105 | 1.8K |
| 108 | 670 |

The voltage drop in resistor 108 for the normal value of $V_{CC}$, e.g. 4.5 volts, is designed to be at about 0.29 volts so that the protective transistor 110 remains off. Transistor 110 is, in fact, held off until $V_{CC}$ reaches 35 volts at which time the voltage across the sense resistor amounts to about 0.6 volts and transistor 108 turns on and shunts essentially all of the bias current away from the base of pass transistor 70 shutting it down.

Figure 1:
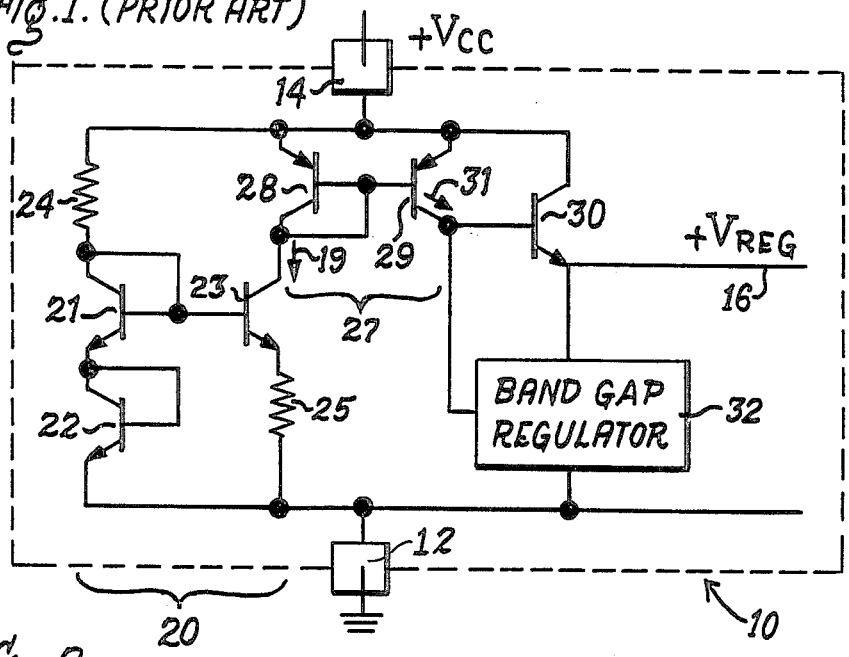
Fig. 1. (PRIOR ART)
FIG. 1 shows an integrated voltage regulator circuit of the prior art.
Figure 4:
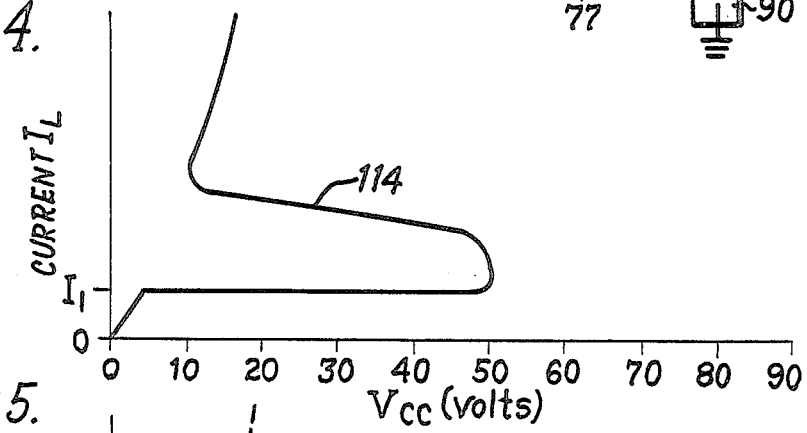
FIG. 4 shows a curve of forward current as a function of DC supply voltage exhibiting a latch-back region for the prior art circuit of FIG. 1.

The pass transistor is a standard NPN transistor of the double diffused type formed in an N-type epitaxial pocket that is defined by a surrounding P-type isolation wall. In a first experiment in which the sense resistor 108 is shorted to disable the protection feature of this invention, and to form the prior art circuit shown in FIG. 1, the emitter current $I_L$ of the pass transistor 70 was monitored as a function of time on an oscilloscope while the DC input voltage, $V_{CC}$, was periodically ramped up. A sketch of the scope curve 114 is shown in FIG. 4.

That pass-transistor current $I_L$ is seen to rise linearly up to a value $I_L$, corresponding to the design voltage value of $V_{REG}$, namely 3.3 volts. It remains nearly constant at this value until at about 50 volts $V_{CC}$ the pass transistor 70 appears to latch fully on.

In a second experiment, the short is removed from across the sense transistor 108 to restore it to the intended protective role. Again, the observation of the pass-transistor current $I_L$ on the scope as a function of time, as the DC input supply voltage $V_{CC}$ is repeatedly ramped up from zero, is represented by the broken line curve 115 of current $I_L$ as a function of $V_{CC}$ in FIG. 5. Here it is seen that the $I_L$ is reached as before at $V_{CC}$ of 4.2 volts. $I_L$ and a $V_{REG}$ of about 3.3 volts remain essentially constant until $V_{CC}$ reaches 35 volts. At 35 volts, transistor 110 turns on and the pass-transistor current $I_L$ drops to a near zero value resulting in the output voltage on conductor 76 becoming near zero also.

Now as the DC supply voltage increases further, the pass-transistor current remains near zero until at about 80 volts the pass transistor 70 appears to break down and latch back as before except at a much higher voltage. This represents a substantial improvement in tolerance of the entire circuit for high voltage transients in the supply voltage $V_{CC}$.

Figure 5:
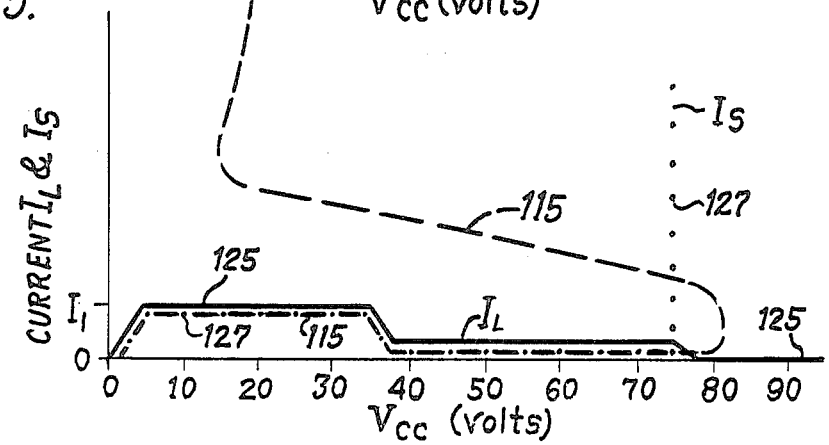
FIG. 5 shows a curve of forward current as a formation of DC supply voltage exhibiting latch-back region for the circuit of FIG. 3.

In a third experiment a 75 volt zener diode 120 is connected across the DC supply terminals 74 and 90 as shown in FIG. 3. With this addition, the performance of the full circuit as illustrated in FIG. 3 is again monitored by the oscilloscope yielding a solid-line curve 125 as shown in FIG. 5. Thus, for positive transients of any amplitude, the load circuit is completely protected, and so is the regulator for high and narrow spike transients on $V_{cc}$ as is further discussed below.

The third and dotted-line curve 127 in FIG. 5 shows the DC supply current $I_S$ drawn under these conditions. Here it is clear that a sustained high value of $V_{CC}$ voltage will cause the zener to overheat and perhaps to also destroy the regulator, if integrated in the same chip. However, the protection sought is mainly from fast high voltage transients, e.g. less than one microsecond, for which purposes the zener is entirely satisfactory for protecting the load, voltage regulator and itself.

The particular pass transistor 70 for which the above-noted data is given represents one from many lots of regulator circuits that has the very lowest latch-back breakdown voltage, i.e. 55 volts. From lot to lot, that voltage ranges from 55 to 75 volts. Thus, the protective circuit including transistor 108 provides protection in the $V_{CC}$ voltage range from 35 to 75 volts while the zener diode 120 takes over protection for $V_{CC}$ greater than 70 volts.

This invention is particularly suitable for mobile electronic gear wherein the source of noise on the DC supply line is derived from engine ignition noise. The high voltage spikes in such noise ranges from narrow, e.g. 10 nanoseconds, for high amplitude spikes on the supply line, e.g. 100 volts, to wide, e.g. 30 microseconds, at spikes with voltages less than 55 volts. The lower/-wider spikes contain much more energy and can destroy a zener diode designed to crowbar at less than 55 volts unless a large series resistor is used in series with the "low voltage" zener. The use of a series resistor with the zener, however, exposes the circuit to latch back at the very narrow high voltage spikes because very little energy is required to initiate latchback.

The latch-back phenomema described here can be sustained continuously after its initial occurrence by a steady $V_{CC}$ voltage of only a few volts, e.g. 10 volts. Sustained latch-back results in catastrophic failure. It is believed to be caused by a forward secondary breakdown of the pass transistor, that is attributable to a thermal run-away beginning at already existing regions of lower resistivity at the base-emitter junction where current tends to concentrate and establish locally reduced values of $V_{BE}$ and high conduction. With the addition of just a little additional energy from a noise spike, thermal run-away can occur. This theory is, however, not crucial to the invention and we would not wish to be held to it.

What is claimed is:

1. An integrated circuit voltage regulator comprising:

(a) a pair of conductors to which a source of an unregulated DC voltage may be connected consisting of a source-voltage conductor and a ground reference conductor, and a regulated-voltage output conductor;

(b) a bipolar pass transistor connected collector-to-emitter directly between said source-voltage conductor and said output conductor;

(d) a current source circuit means connected between said source-voltage conductor and the base of said pass transistor for providing a bias current to the base of said pass transistor;

(e) a voltage regulator circuit means having a voltage-sensing branch connected between said output conductor and said ground conductor and a feedback branch connected to the base of said pass transistor for regulating the DC voltage at said output conductor; and (f) a transisent voltage protection circuit means connected to said source-voltage conductor, to the base of said pass transistor and to said ground conductor for shunting said base bias current away from the base of said pass transistor when the voltage at said source-voltage conductor exceeds a predetermined fixed value which is less than the latch-back breakdown voltage of said pass transistor.

2. The regulator of claim 1 additionally comprising a zener diode means connected directly across the voltage source and ground terminals for providing a crowbar clamp thereacross when said voltage on said source-voltage conductor is less than said breakdown voltage and is greater than said predetermined value.

3. An integrated circuit voltage regulator comprising:

(a) a pair of conductors to which a source of an unregulated DC voltage may be connected consisting of a source-voltage conductor and a ground reference conductor, and a regulated-voltage output conductor;

(b) a bipolar pass transistor connected collector-to-emitter between said source-voltage conductor and said output conductor;

(c) a current source circuit means connected between said source-voltage conductor and the base of said pass transistor for providing a bias current to the base of said pass transistor;

(d) a voltage regulator circuit means having a voltage-sensing branch connected between said output conductor and said ground conductor and a feedback branch connected to the base of said pass transistor for regulating the DC voltage at said output conductor; and (e) a transient voltage protection circuit means for shunting said base bias current away from the base of said pass transistor when the voltage at said source-voltage conductor exceeds a predetermined value which is less than the latch-back breakdown voltage of said pass transistor, said transient voltage protection circuit being comprised of a bipolar protection transistor having a collector connected to the pass-transistor base and an emitter connected to said ground conductor, and a resistor means connected between said source-voltage conductor and the base of said protection transistor for turning on said protection transistor when said voltage at said source-voltage conductor exceeds said predetermined value.

4. The voltage regulator of claim 3 wherein said transient voltage protection circuit means is additionally comprised of a sense resistor connected across the base and emitter of said protective transistor and connected between said source-voltage conductor and said ground reference conductor so that the voltage dropped by said sense resistor is directly related to the unregulated DC voltage.

5. The regulator of claim 4 wherein said current source circuit means is comprised of a floating conductor; a standard current source circuit having a reference-current branch including a resistor and a diode connected in series and in that order between said source-voltage conductor and said floating conductor, said standard current-source circuit further comprising an output branch including a bipolar transistor and an emitter resistor connected in series collector-to-emitter-to-emitter-resistor, the base of said output current being connected to the junction between said diode and resistor in said reference current branch, and said emitter resistor being connected to said floating conductor, said sense resistor being connected between said floating conductor and said ground conductor.

6. The regulator of claim 3 additionally comprising a zener diode means connected directly across the voltage source and ground terminals for providing a crowbar clamp thereacross when said voltage on said source-voltage conductor is less than said breakdown voltage and is greater than said predetermined value.

* * * * *